United States Patent [19]

Braun et al.

[11] 4,326,674

[45] Apr. 27, 1982

[54] DEVICE FOR THE HOMOGENIZATION OF MATERIAL TO BE CRUSHED

[75] Inventors: Ernst Braun; Gert Braun, both of Essen-Heisingen, Fed. Rep. of Germany

[73] Assignee: Halbach & Braun, Fed. Rep. of Germany

[21] Appl. No.: 117,120

[22] Filed: Jan. 31, 1980

[30] Foreign Application Priority Data

Feb. 8, 1979 [DE] Fed. Rep. of Germany ..... 2904694

[51] Int. Cl.[3] ..... B02C 13/286

[52] U.S. Cl. ..... 241/35; 241/81; 241/86; 241/186.3; 241/189 R

[58] Field of Search ..... 209/352, 247, 233, 235; 241/81, 87, 95, 89.2, 35, 85, 86, 88.4, 24, 189 R, 186.3, 223, 186 R

[56] References Cited

U.S. PATENT DOCUMENTS

| | | | |
|---|---|---|---|
| 2,791,252 | 5/1957 | Church | 241/35 |
| 3,459,378 | 8/1969 | Hill | 241/35 |
| 3,934,826 | 1/1976 | Graveman | 241/81 |
| 3,998,396 | 12/1976 | Umphrey et al. | 241/81 |
| 4,047,673 | 9/1977 | Aulmann et al. | 241/186 R |
| 4,061,398 | 12/1977 | Parkes | 241/186 R X |

FOREIGN PATENT DOCUMENTS

| | | | |
|---|---|---|---|
| 8081 | of 1906 | United Kingdom | 209/352 |

*Primary Examiner*—Mark Rosenbaum
*Attorney, Agent, or Firm*—McGlew and Tuttle

[57] ABSTRACT

A device for the homogenization of material to be crushed particularly for crushing coal to uniform grain size comprises a first conveyor for feeding the material to be crushed which has an upper section and a lower section which extends downwardly away from and below the upper section. A coarse material conveyor overlies the lower section and is disposed at the level of the upper section and between it and the upper section there is a grading device which permits deflection of the fine material so that it is fed downwardly with the lower section and the transfer of the coarse material over the lower section onto a perforated crusher plate. A crushing roll is disposed above the crusher plate in a position to crush the coarse material which is fed thereon to a side operable to the material carried by the lower section and to deposit this material onto the lower section by passage through the openings of the crusher plate.

12 Claims, 3 Drawing Figures

1
2
3
3
4
5
6
6a
6b
7
8
9
10
11
12
16
17
18

5
6
7
9
11
12
13
14
15
16
17
18

DEVICE FOR THE HOMOGENIZATION OF MATERIAL TO BE CRUSHED

FIELD AND BACKGROUND OF THE INVENTION

The invention relates to equipment for the homogenization of material, particularly coal, to be crushed to essentially uniform grain size, comprising a roll crusher to crush coarse material by means of a crushing roll and a crushing plate mounted below the crushing roll at a specified passing level of the material to be crushed, and a conveyor to feed in the material to be crushed and homogenized.

It is known to crush material, particularly coal, in underground mining by means of a roll crusher such as a single roll crusher. For this purpose, the material to be crushed is fed to the roll crusher by a conveyor, particularly a chain scraper conveyor. The material to be crushed is usually not of uniform grain size, i.e. it consists of fine and coarse material. Crushing the fine material is unnecessary, yet the hitherto known crushing equipment is designed so that the coarse material to be crushed as well as, unnecessarily, the fine material is fed to the roll crusher. The crushing output is automatically reduced by the unnecessary feeding in of the fine material, and the efficiency of the crushing equipment as a whole is adversely affected. Nor is overloading of the crushing roll precluded due to the backing up of material to be crushed. For it is precisely the fine material which can lead to such a backup effect. Finally, the fine material causes considerable dust development, which is undesirable.

SUMMARY OF THE INVENTION

The invention provides equipment for the homogenization of material to be crushed, particularly coal, to uniform grain size, operating with increased throughput and optimum efficiency while avoiding unnecessary dust development.

In accordance with the invention, a conveyor is at crushing plate level until shortly before the crushing plate, and is then deflected downwardly to continue below the crushing plate, and there is disposed in the conveyor deflection area between the conveyor and the crushing plate, a grading device to separate the coarse material to be crushed from the fine material carried along. Also conveying means is located above the crushing plate and it runs underneath the crushing roll to receive and forward the coarse material to be crushed as well as material already crushed by the crushing roll, the conveying means drops the coarse material, crushed to the grain size of the fine material, onto the conveyor disposed behind the roll crusher, thereby returning the crushed coarse material in the appropriate grain size to the fine material carried along by the conveyor.

The consequence of these inventive measures is that the coarse material to be crushed is separated from the fine material for the crushing operation and fed to the roll crusher alone, whereas the fine material which needs no further crushing is forwarded separately. Behind the roll crusher, the crushed coarse material is then transferred again in appropriate grain size to the fine material. Therefore, the fine material, withdrawn from the material to be crushed for the crushing operation, no longer burdens the roll crusher, and consequently, can lead neither to dust development ahead of the roll crusher nor to dust development in the course of the crushing operation. But, due to the separation of the coarse material to be crushed from the fine material, it is not only a relief of the roll crusher that is accomplished; its throughput is increased on the one hand and its efficiency optimized on the other. For, the crushing operation is restricted to the coarse material which is returned to the fine material again only after its grain size was reduced appropriately.

Other features characteristic of the invention are described in the following: For example, the conveyor of the equipment according to the invention may also be designed as chain scraper conveyor such as a double center chain conveyor. According to a preferred embodiment of the invention with independent significance, the grading device is designed in the form of a grading plate, onto which the coarse material to be crushed runs from the raw material fed in, and which transfers the accumulated coarse material to the succeeding conveying means on the crushing plate. In other words, the grading plate skims the coarse material off the arriving material to be crushed, as it were, whereas the fine material is forwarded on below the grading plate. According to the invention, the grading plate is designed as a plate widening in wedge-shape in conveying direction, its undersiding serving as top guide of the chain strand and of the chain scraper conveyor drivers. Preferaby, the grading plate has stripper fingers oriented against the conveying direction while the chain scraper conveyor drivers have corresponding stripper recesses so that the coarse material to be crushed is taken from the arriving material in forklike fashion, as it were, at least up to the driver level. In order to avoid with increased reliability the transfer of fine material to the roll crusher, the invention recommends further that a variable grading gap be provided between the grading plate and the succeeding conveying means, which gap is open towards the conveyor located below it. By adjusting the grading gap, therefore, fine material of a specified grain size can be separated additionally from the coarse material to be crushed before it enters the roll crusher, if carried incidentally with the coarse material over the grading plate. The invention provides further that the crushing plate is designed as screen plate with specified screen hole density and size so that the fine material, obtained in the actual crushing zone in the course of crushing the coarse material, can drop through the crushing plate onto the conveyor below it. On account of these matters, the loading of the roll crusher and the dust development due to fine material are kept as small as possible at all times.

According to a preferred embodiment of the invention, the conveying means for the coarse material to be crushed and already crushed is designed as a scraper belt revolving around the crushing plate, with flat scrapers and its own drive unit. The invention is based on the knowledge that flat scrapers do not only make for a low structural height, but also do not interfere with the crushing operation between crushing roll and crushing plate, and they can stand the stresses active in the crushing zone without difficulty. Irrespective thereof, the drive unit for the conveying means may have a speed-dependent overload protection, operating as a function of a speed regulator coordinated with the crushing roll. This affords the possibility of shutting off the drive unit or the drive motor for the scraper belt when the crushing roll becomes overload, and having the crushing roll resume speed again in short order. As the crushing roll resumes speed, the scraper belt starts up again. During this process, the conveyor running under the roll crusher continues unchanged to carry away fine material.

It is expedient for the conveyor, the grading device, and the roll crusher with the crushing plate and the conveying means revolving around it to be mounted, within the equipment area, in a housing divisible in a building block fashion. This causes the entire grading and crushing operation to take place in a protective housing. This housing, due to its modular design, can be removed piecemeal in the event of breakdowns in those areas only where assembly or repair work is required.

Accordingly, it is an object of the invention to provide a device for the homogenization of material to be crushed and particularly coal, to a uniform grain size which comprises a first conveyor for feeding the material to be crushed which has an upper section and a lower section extending downwardly from and below the upper section and which includes coarse material conveyor means overlying the lower section and disposed at the level of the upper section with a grading device disposed between the upper section and the coarse material conveyor means and acting to deflect the coarse particles from the material to be crushed and to move it from the upper section to the coarse material conveyor means while permitting the fine material to be fed from the upper section to the lower section of the conveyor and which further includes a pressure plate disposed adjacent the coarse material conveyor means below the coarse material being fed thereby and crusher means overlying the coarse material conveyor means in a position to crush the material being fed thereby and cause it to be deposited on the lower section of the conveyor.

A further object of the invention is to provide a device for the homogenization of material to be crushed to uniform grain size which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
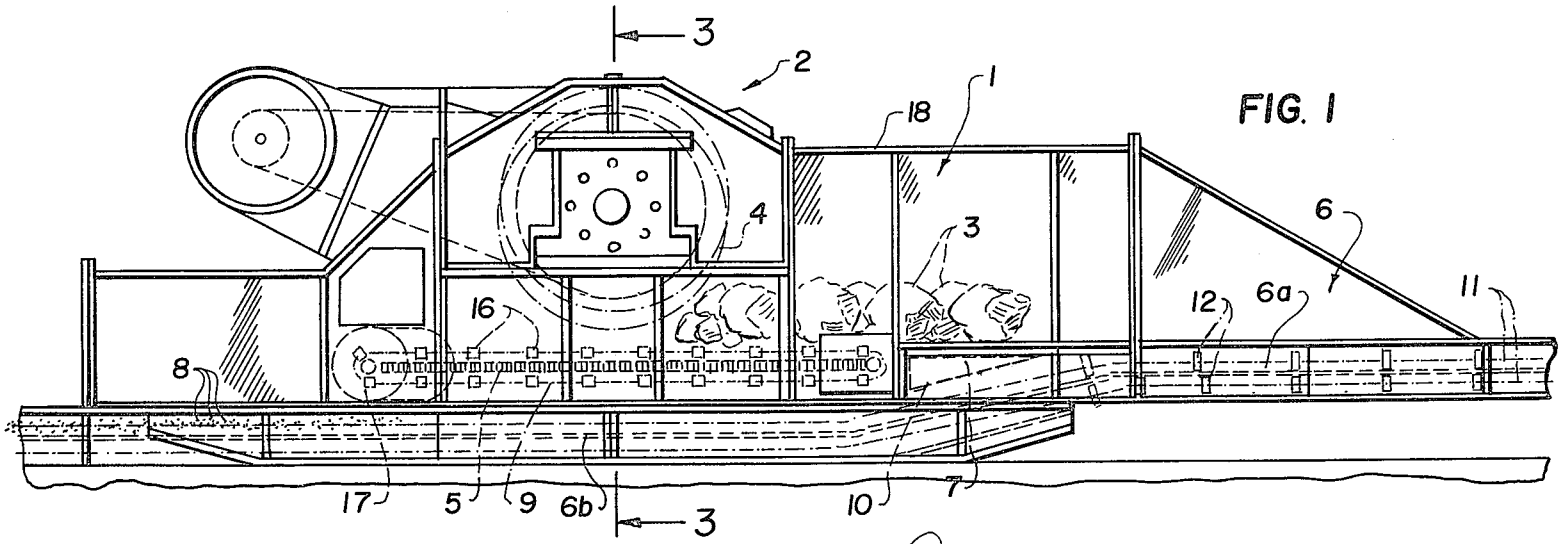
FIG. 1 is a schematic side elevational view of a device for the homogenization of material to be crushed constructed in accordance with the invention.
Figure 2:
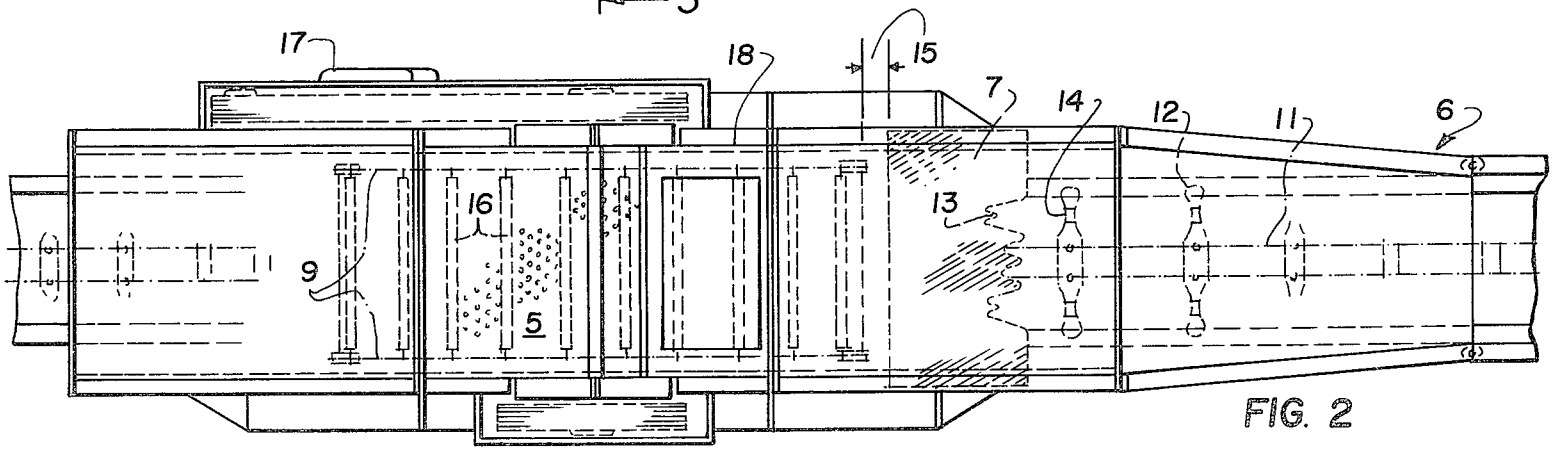
FIG. 2 is a top plan view of the device shown in FIG. 1.
Figure 3:
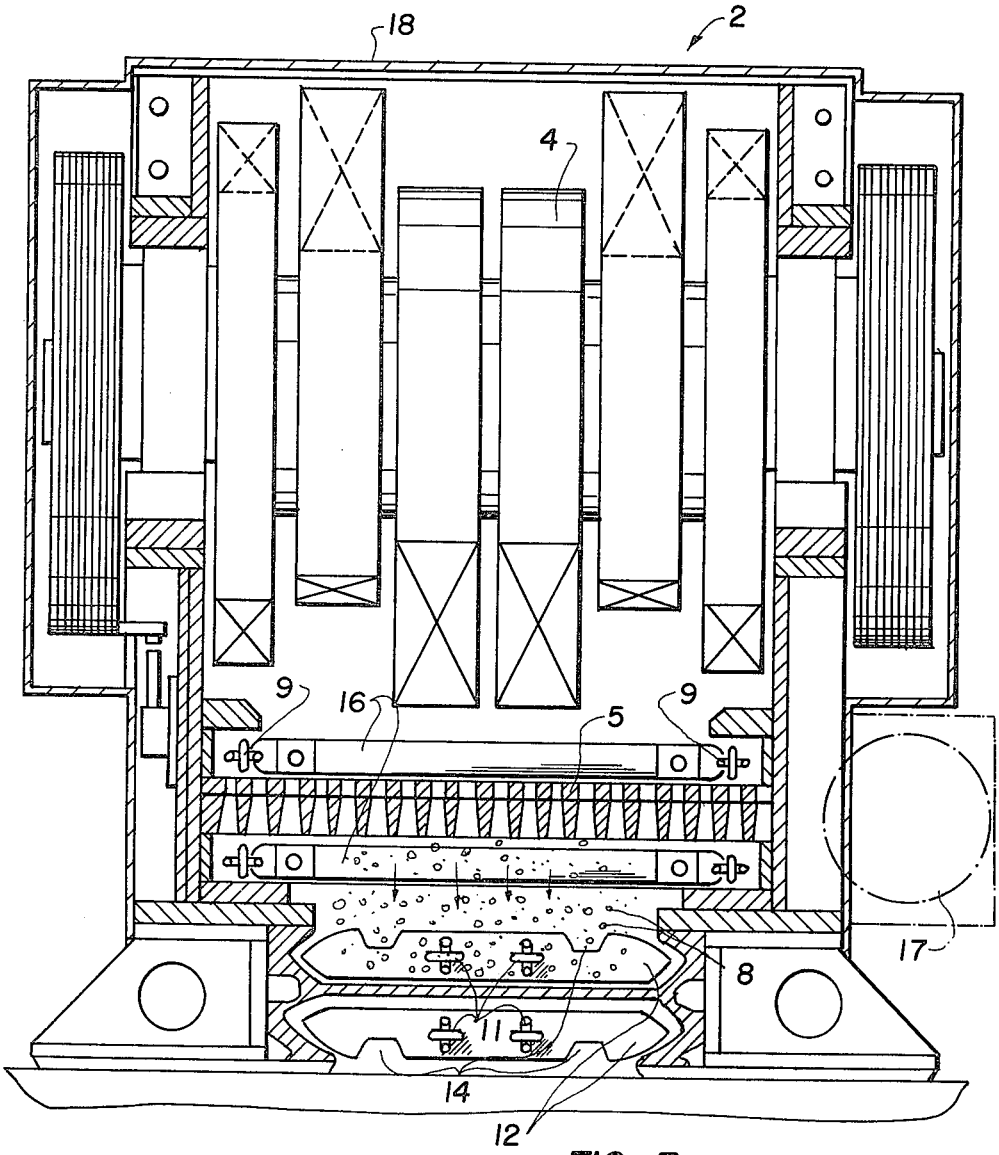
FIG. 3 is a vertical sectional view taken along the line 3—3 of FIG. 1.

Referring to the drawings in particular the invention embodied therein comprises, a device for the homogenization of material and particularly for crushing coal to uniform grain size which includes crusher means in the form of a crushing roll arranged below a perforated crushing plate 5 in a conveyor 6 for feeding the material to be crushed into association with the crusher roll while separating fine material from the raw material received so that the crusher roll operates primarily only on the coarse material in an arrangement whereby the material which is fed away from the crusher is of uniform grain size.

Shown in the Figures is the equipment for the homogenization of material to be crushed 1, particularly coal, to essentially uniform grain size. This equipment contains a roll crusher 2 to crush coarse material 3 by means of a crushing roll 4 on a crushing plate 5 mounted below the crushing roll 4 at a specified level for the material to be crushed to pass through. In addition, a conveyor 6 sees to it that the material 1 to be crushed and homogenized is fed in. Up to shortly before the crushing plate 5, the conveyor 6 has a section **6*a* which runs at the level of the crushing plate 5 and a section 6*b* which runs below plate 5. The conveyor 6 is therefore deflected downwardly and continues on underneath the crushing plate 5. A grading device 7 is disposed in a deflection area of the conveyor 6 between the conveyor 6 and the crushing plate 5 to separate the coarse material 3 to be crushed from the fine material 8 carried along by the conveyor. Guided above the crushing plate 5 is a conveying means 9 in the form of a second conveyor which passes underneath the crushing roll 4. The conveying means 9 receives and forwards the coarse material 3 from the section 6*a* so that it is crushed by the crushing roll 4 as it is moved beneath it. The conveying means 9 deposits the crushed material onto the lower section 6*b* of the conveyor 6 behind the roll crusher 2 so that the coarse material 3 is crushed to the grain size of the fine material 8, thereby returning the crushed coarse material 3 in the appropriate grain size to the fine material 8 again which was carried along unchanged by the conveyor 6**.

The conveyor 6 is designed as chain scraper conveyor and in the embodiment example as a double center chain conveyor. The grading device comprises a grading plate 7, onto which the coarse material 3 to be crushed runs from the raw material 1 fed in, the plate 7 transfers the accumulated coarse material 3 to the succeeding conveying means 9 which moves over the crushing plate 5. Furthermore, the grading plate 7 is designed as a plate which is wedge shaped in vertical section and widens in conveying direction downwardly towards the crushing plate 5; its underside serving as a top guide 10 of the chain strand 11 and of the drivers 12 of the double center chain conveyor 6. In addition, the grading plate 7 has stripper fingers 13 extending against the conveying direction while the chain scraper conveyor drivers 12 have corresponding stripper recesses 14 in order to be able to skim the coarse material 3 to be crushed deep enough from the conveyed flow of raw material 1. Disposed between the grading plate 7, and the conveying means 9 following it, is a variable grading gap 15 which is open towards the lower section **6*b* of the conveyor 6 located below it and makes possible the transfer of additional fine material 8, which is incidentally received by the grading plate 7 along with the coarse material 3, to the conveyor 6 before entry into the roll crusher 2. The crushing plate 5 is a perforated plate, with specified hole density and size, in order to let the fine material 8 of specified grain size, obtained in the course of the crushing operation, drop directly through the crushing plate 5 onto the conveyor 6** running underneath it.

The conveying means 9 is designed as a scraper belt with flat scrapers 16 and its own drive unit 17, so that the belt revolves around the crushing plate 5. The drive unit 17 of the conveying means 9 contains a speed-dependent overload protection which operates as a function of a speed regulator coordinated with the crushing roll 4. In case the crushing roll 4 becomes overloaded, the drive unit 17 of the conveying means 9 can be shut off through the speed regulator. Only after the crushing roll 4 resumes speed does the conveying means 9 start up again. The conveyor 6, the grading device 7, and the roll crusher 2 with the crushing plate 5 and the conveying means 9 revolving around it are mounted—within the crushing equipment area—in a housing 18 divided into sections or parts in building block fashion so that housing parts can be removed in places to carry out repair or assembly work.

While specific embodiments of the invention have been shown and described in detail to illustrate the application of the principles of the invention, it will be understood that the invention may be embodied otherwise without departing from such principles.

What is claimed is:

1. In a device for sizing breakable material, the materials being composed of a coarse material and a fine material, particularly coal, to a substantially uniform size, of the type having a crushing plate, a rollcrusher for roll crushing the coarse material on the crusher plate, the crusher plate being mounted below the roll crusher at a level leaving a predetermined clearance for the material to be crushed and a conveyor for feeding the material to be crushed through the crushing plate, in combination therewith, the improvement wherein the conveyor is mounted to initially run at the level of the crusher plate, is then deflected downwardly in a deflection area short of the crusher plate to run below the level of the crusher plate, and further comprising grading means in the deflection area between the conveyor and the crusher plate for separating the coarse material to be crushed from the fine material, and conveying means mounted above the crusher plate for receiving the separated coarse material from the grading means and conveying the separated coarse material beneath the roll crusher from an upstream side to a downstream side for fragmentation, thereby causing the coarse material to be fragmented to the size of the fine material, said conveying means including means for discharging the crushed coarse material downstream of the roll crusher onto the conveyor thereby again adding the crushed coarse material to the fine material on the conveyor.

2. A device according to claim 1, wherein said grading means comprises a grading plate mounted at the level of the crushing plate and upstream of the crushing plate in the direction of conveying for transferring the coarse material to the conveying means.

3. An improved device for the homogenization of material to be crushed particularly for crushing coal to uniform grain size, the material being composed of coarse material and fine material, of the type having a crushing plate, a roll crusher for crushing the coarse material on the crushing plate, and a conveyor for feeding the material to the crushing plate, the improvement wherein the conveyor comprises an upper section extending at a level and a lower section extending downwardly and away from and below the level of said upper section, a coarse material conveyor means overlying the lower section and disposed at the level of said upper section, grading means disposed between said upper section and said coarse material conveyor means for deflecting the coarse material to be crushed and for moving the coarse material from the upper section to said coarse material conveyor means while permitting the fine material to feed from the upper section to the lower section of said conveyor, and wherein the crushing plate comprises a perforated crusher plate having a perforation, said crusher plate being disposed adjacent said coarse material conveyor means below the coarse material being fed thereby, the roller crusher being mounted overlying said coarse material conveyor means and said crushing plate for crushing the coarse material to a size to pass it through the perforation of said crushing plate and deposit it on said lower section.

4. A device according to claim 1 or 3, wherein said conveyor comprises a chain scraper conveyor.

5. A device according to claim 4, wherein said chain scraper conveyor comprises a double center chain conveyor.

6. A device according to claim 3, wherein said grading means comprises a grading plate having a top surface at the level of said upper section for the passage of the coarse material thereover and having portions deflecting the coarse material off the upper section onto the top surface of said grading plate so that it is transferred to said coarse material conveyor means.

7. A device according to claims 2 or 6, wherein said grading plate has a wedge-shaped cross-section in vertical section and widens downwardly in the conveying direction, the underside of said grading plate defining an upper guide for said conveyor, said conveyor having drivers guided by the underside of said grading plate.

8. A device according to claim 7, wherein said grading plate has stripper fingers oriented in the conveyor direction, said drivers having corresponding stripper recesses into which said fingers extend.

9. A device according to claim 3, wherein said grading means comprises a plate disposed between said course material conveyor means and said upper section, said plate being spaced from said coarse material conveyor means by a variable grading gap which opens downwardly towards said lower section.

10. A device according to claim 3, wherein said crushing plate comprises a screen plate having specified screen hole density and size.

11. A device according to claim 3, wherein said coarse material conveying means comprises a scraper belt having flat scrapers, a separate drive unit for said coarse material conveyor, said scrapers revolving around said crushing plate.

12. A device according to claim 11, wherein said driving unit of said coarse material conveyor means contains a speed dependent overload protection which operates as a function of a speed regulator coordinate with said crushing means, said crushing means comprising a rotatable crushing roll.

* * * * *